US005862653A

United States Patent [19]

Solano

[11] Patent Number: 5,862,653

[45] Date of Patent: Jan. 26, 1999

[54] FLEXIBLE PACKAGE HANDLING DEVICE

[75] Inventor: Jose Ma Broto Solano, Barcelona, Spain

[73] Assignee: Bossar, S.A., Barcelona, Spain

[21] Appl. No.: 750,707

[22] PCT Filed: Apr. 17, 1996

[86] PCT No.: PCT/ES96/00089

§ 371 Date: Mar. 19, 1997

§ 102(e) Date: Mar. 19, 1997

[87] PCT Pub. No.: WO96/33094

PCT Pub. Date: Oct. 24, 1996

[30] Foreign Application Priority Data

Apr. 17, 1995 [ES] Spain ..... 9500746

[51] Int. Cl.[6] ..... B65B 1/02; B65B 9/08; B65B 43/46

[52] U.S. Cl. ..... 53/562; 53/284.7; 53/384.1

[58] Field of Search ..... 53/562, 455, 570, 53/573, 284.7, 384.1, 249, 250

[56] References Cited

U.S. PATENT DOCUMENTS

| | | | |
|---|---|---|---|
| 3,568,402 | 3/1971 | Lense et al. | 53/384 |
| 3,700,388 | 10/1972 | Johnson et al. | 53/562 |
| 3,855,907 | 12/1974 | Johnson et al. | 53/562 X |
| 4,156,336 | 5/1979 | Tabaroni et al. | 53/562 |
| 4,509,313 | 4/1985 | Koppe | 53/570 |
| 5,058,364 | 10/1991 | Seiden et al. | 53/562 X |
| 5,564,252 | 10/1996 | Adelmann | 53/562 X |

FOREIGN PATENT DOCUMENTS

| | | |
|---|---|---|
| 35 03 992 | 8/1986 | Germany . |
| 534137 | 7/1984 | Spain . |

OTHER PUBLICATIONS

International Search Report No. PCT/ES96/00089, dated July 25, 1996, 3 pp.

*Primary Examiner*—James F. Coan
*Attorney, Agent, or Firm*—Finnegan, Henderson, Farabow, Garrett & Dunner. L.L.P.

[57] ABSTRACT

Device for handling flexible packages, of the type used in horizontal packing machines that are used to form packets from a heat-sealable complex sheet, fill them with the product to be packed and heat-seal the openings when they are full. The device includes scissors for cutting the packets that are formed continuously from the complex sheet, a packet-lifting mechanism and a revolving mechanism that moves horizontally. The revolving mechanism consists of a moving chain, and several sets of carrying clips that are attached horizontally to the outer sides of the chain. The carrying clips pick up the packets supplied by the lifting clips at a collection station, move them horizontally through the packing machine filling and sealing stations and finally release them at a packet release station.

12 Claims, 5 Drawing Sheets

FLEXIBLE PACKAGE HANDLING DEVICE

OBJECT OF THE INVENTION

As its title indicates, the invention proposed herein consists of a device for handling flexible packages, of the type used in horizontal packing machines that are used to form packets from a heat-sealable complex sheet, fill them with the product to be packed and heat-seal the openings when they are full. The device includes scissors for cutting the packets that are formed continuously from the complex sheet, a packet-lifting mechanism and a revolving mechanism that moves horizontally. The revolving mechanism consists of a moving chain, and several sets of carrying clips that are attached horizontally to the outer sides of the chain. The carrying clips pick up the packets supplied by the lifting clips at a collection station, move them horizontally through the packing machine filling and sealing stations and finally release them at a packet release station.

BACKGROUND TO THE INVENTION

At present there are devices for handling flexible packages or containers, and more specifically packets, that include a revolving mechanism that moves along a vertical plane, while the two driving and driven sections of the chain move along a horizontal plane at different heights. Therefore, when the packets are being filled by the packing machine, the product that is being poured into the packets sometimes spills onto the chains and moving parts of the device, causing the device to break down or malfunction. As a result, the moving parts must be cleaned at regular intervals to remove any product that has been spilt.

After picking up the packets, these devices have to carry them through the different stations of the packing machine to which they are attached, open the packets to fill them and then stretch the packet opening so that it can be heat-sealed. For the aforementioned reasons, these well-known devices are highly complex in mechanical terms, and this affects their final price.

DESCRIPTION OF THE INVENTION

The device described herein includes at least one scissors for cutting the packets formed continuously from a complex sheet, a packet-lifting mechanism that picks up the packets when they have been cut, and a revolving mechanism equipped with several sets of clips that carry the packets through the filling and sealing stations of the packing machine, and finally release them in a packet release station.

The revolving mechanism moves along a closed horizontal plane and consists of a chain driven by a power unit that makes it move intermittently; attached horizontally to the outer sides of the chain there are several sets of carrying clips that pick up the packets supplied by the lifting pins at the collection station.

At each side of the revolving mechanism chain there are guides to prevent it from bending and vibrating while it is moving.

The packet-lifting mechanism includes two parallel clips that move up and down on a bracket located above the revolving mechanism. The packets are very close to each other when they are picked up by the clips, so one of the chain guides is vertical and the other is oblique. Consequently, as the clips move upwards, each packet moves away from the next packet, making it easier for each set of revolving mechanism clips to pick up one packet.

In the invention, each set of clips consists of one central clip and two side clips; the central clips have a fixed arm and two lateral presser arms operated by two springs that press them against the fixed arm, keeping them in the closed position. The side clips have a folding arm mounted on a bracket, attached to the chain by a vertical shaft to make it possible to fold or unfold the arms horizontally, taking the ends of the side clips closer to or further from the central clip, and a spring-operated presser arm that moves the folding arm.

Attached to the side of the side clip folding arms is an appendage equipped with an end wheel; on one of these side clips, the end wheel is mounted on top of the appendage and, on the other, below it, as a result of which the end wheels are at different heights.

These end wheels enter into frontal contact with support devices located parallel to the path followed by the sets of clips, making the side clips move to a given position in the different stations (packet collection, filling, sealing or packet release).

In the area where the packets are picked up by the sets of clips, the side clip end wheel support means consist of two front guide sections that unfold the side clips, setting them at the same distance from the central clip as the width of the packets to be handled.

In the packet filling station, the side clip end wheel support means consist of a sliding pusher which, when it enters the plane defined by the front guide sections (in-position), folds the side clips located in the station and moves them closer to the central clip in order to open the top of the packets held by the set of clips that is in the filling station.

In the packet-top closing station area, the side clip end wheel support devices consist of two end guide sections that define a front sloping section that starts at the plane defined by the sliding pusher in-position, and an end section on the same plane as the front guide sections located in the packet-collection station, making the side clips unfold and closing the packet tops so that they can be heat sealed.

To make the clips open and close in order to pick up and release the packets, presser bars act simultaneously on the presser arms of each set of clips.

The scissors, the presser bars that open and close the clips and the lifting clips are operated by a set of independent levers operated by a camshaft driven by the power unit that moves the revolving mechanism.

DESCRIPTION OF THE DRAWINGS

A set of drawings have been enclosed with this specification, of which they form an integral part, in order to supplement this specification and make it easier to understand the features of the invention. These drawings, which are provided for the purposes of illustration and are by no means of a limiting nature, show the following.

PREFERABLE EMBODIMENT OF THE INVENTION

Figure 1:
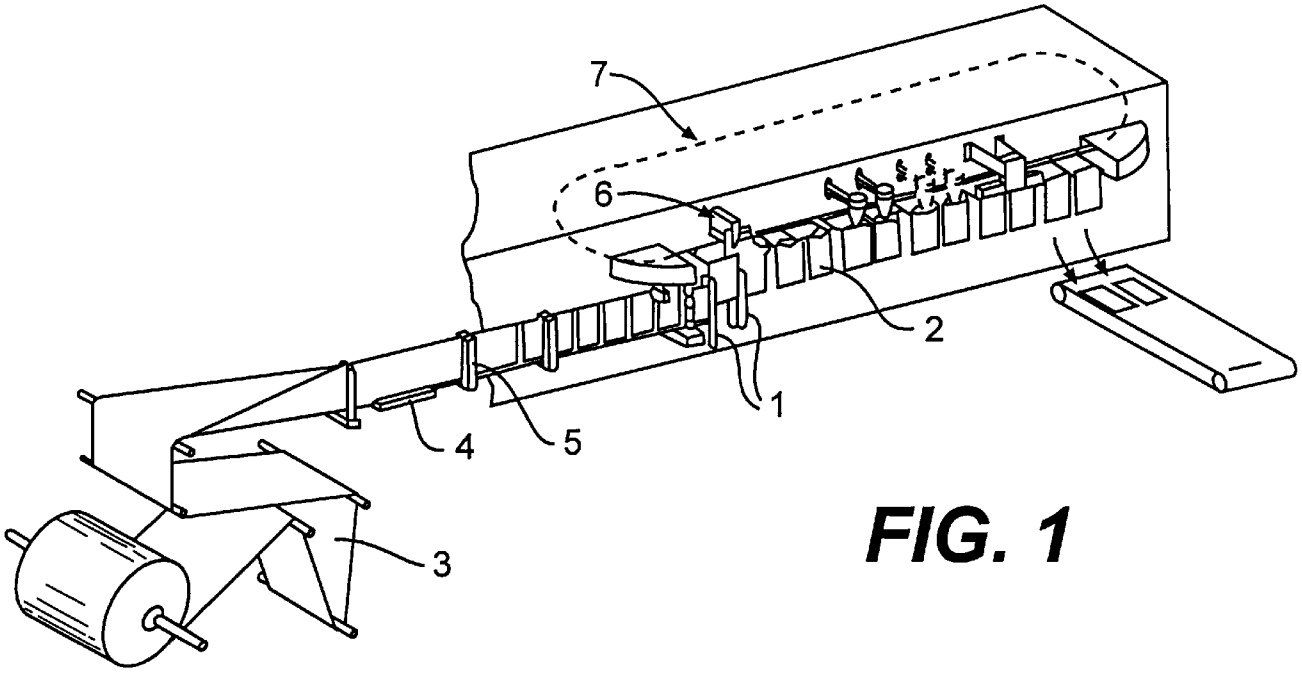
FIG. 1 is a perspective view of the device described herein, applied to a horizontal packing machine.
Figure 2:
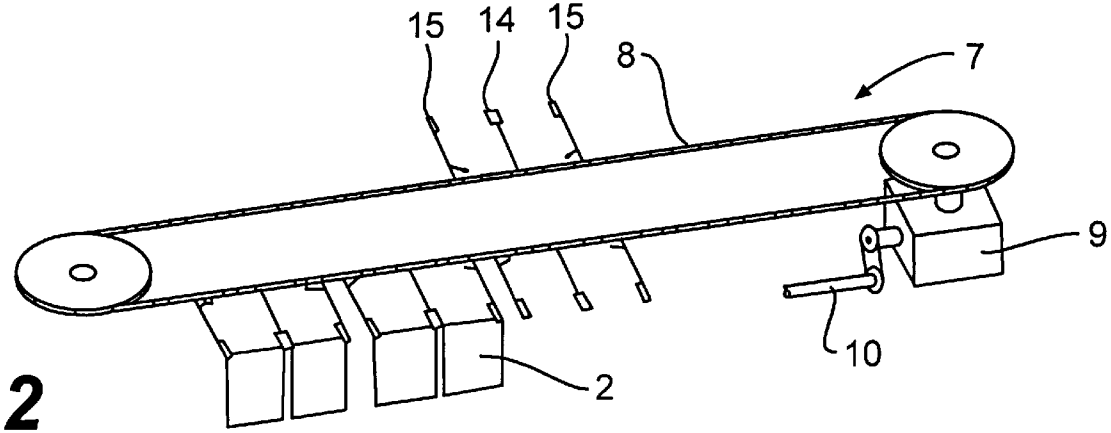
FIG. 2 is a perspective schematic view of the revolving mechanism, showing several sets of clips attached to the chain and also showing the camshaft connected to the power unit.

As can be seen from the aforementioned drawings, the flexible container handling device includes two scissors (1) that cut the packets that are formed continuously from a complex sheet (3) that is folded lengthways and then sealed at the bottom and sides by the sealing devices (4 and 5). The tops of the packets (2) are left unsealed when they are cut by the scissors (1).

The device also includes a packet-lifting mechanism (6) and a revolving mechanism (7) that consists of a chain (8) to the sides of which are attached several sets of clips that pick up the packets (2) delivered by the mechanism (6), move them horizontally to the filling and sealing stations that form part of the packing machine and finally release them at a packet release station.

The chain (8) is driven by a power unit (9) that makes the chain move intermittently, making the sets of clips move from one station to another.

The power unit (9) also drives a camshaft (10) that is coupled to the power unit by a mechanical transmission.

Figure 3:
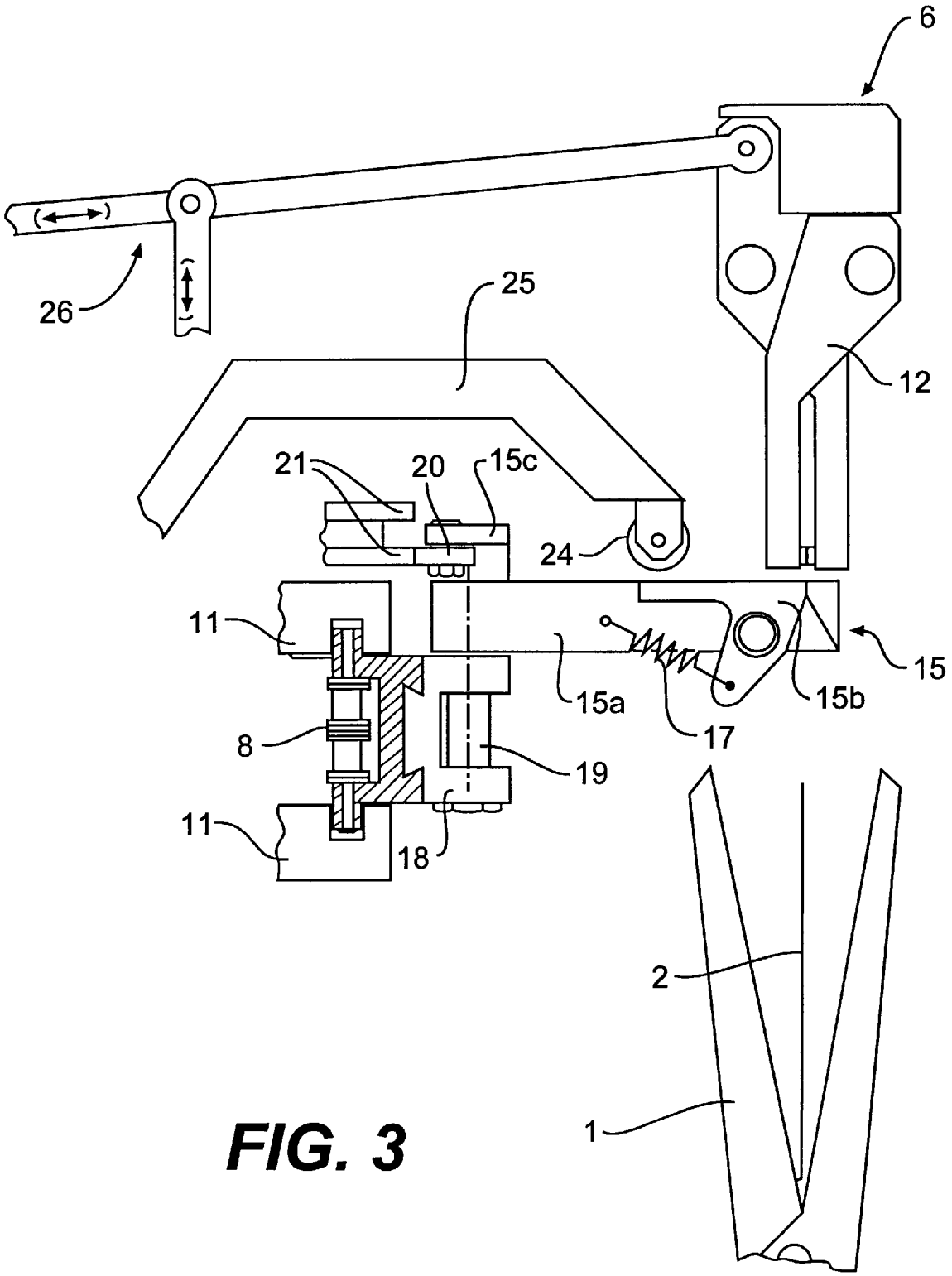
FIG. 3 is a profile view of the packet collection station, seen from the clips of the revolving mechanism and showing one of the lifting clips, one of the revolving mechanism clips and one of the pairs of scissors.

As may be observed in FIG. 3, at each side of the chain (8) there are guides to prevent it from bending and vibrating while it is moving.

Figure 4:
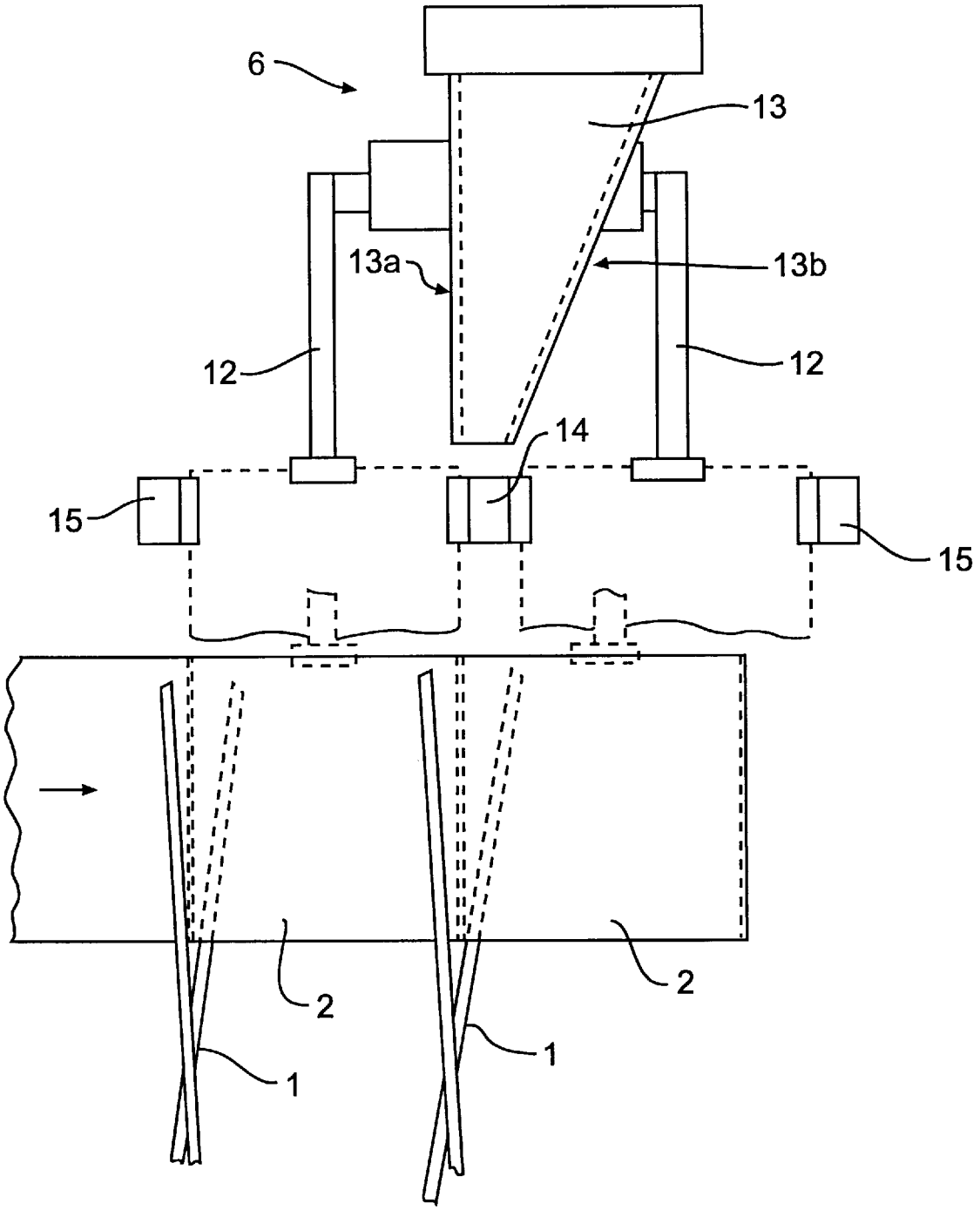
FIG. 4 is a schematic elevation view of a set of clips in the packet collection area, of the packet-lifting device and of the scissors.

The packet-lifting mechanism (6) shown in FIG. 4 includes two parallel clips (12) that move up and down on a bracket (13) located above the revolving mechanism (7).

Attached to the sides of this bracket (13) are a vertical guide **(13*a*) and an oblique guide (13*b*)** upon which the respective lifting clips move.

Each set of clips mounted on the revolving mechanisms (7) includes a central clip (14) and two side clips (15). The central clip of each set consists of a fixed arm **(14*a*) and two presser arms (14*b*) operated by two springs (16) that press them against the fixed arm (14*a*). The central clip (14)** is normally in the closed position.

The side clips (15) of each set consist of a folding arm **(15*a*) and a presser arm (15*b*), operated by a spring (17)**, that acts against the folding arm.

The folding arms **(15*a*) of the side clips (15) are mounted via a vertical shaft (19) on a bracket (18), attached to the chain; the shaft allows the arms to fold or unfold horizontally, taking the ends of the side clips (15) closer to or further from the central clip (14)**, respectively.

Attached to the side of the arms **(15*a*) is an appendage (15*c*) equipped with an end wheel (20)** that acts as a feeler on support devices located parallel to the path of the sets of clips.

Figure 7:
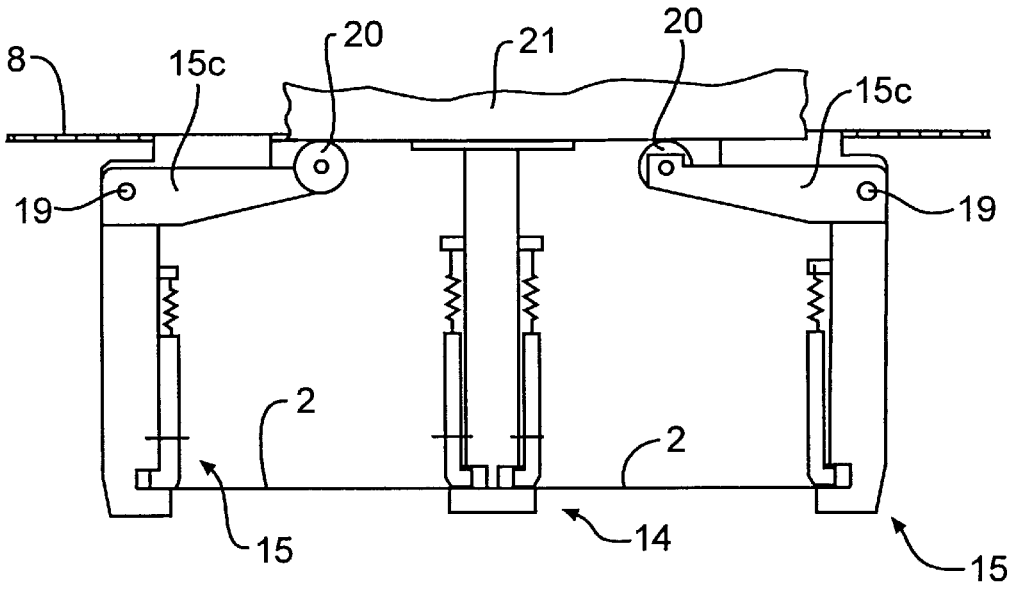
FIG. 7 is a plan view of one of the sets of clips holding two packets at the collection station.

In the packet collection area, these support devices consist of two front guide sections (21) that place the side clips (15) in the unfolded position, as may be seen in FIG. 7, so that they stay at the same distance from the central clip (14) as the width of the packets (2) that are to be handled, in order to pick up and hold the packets by their sides.

Figure 8:
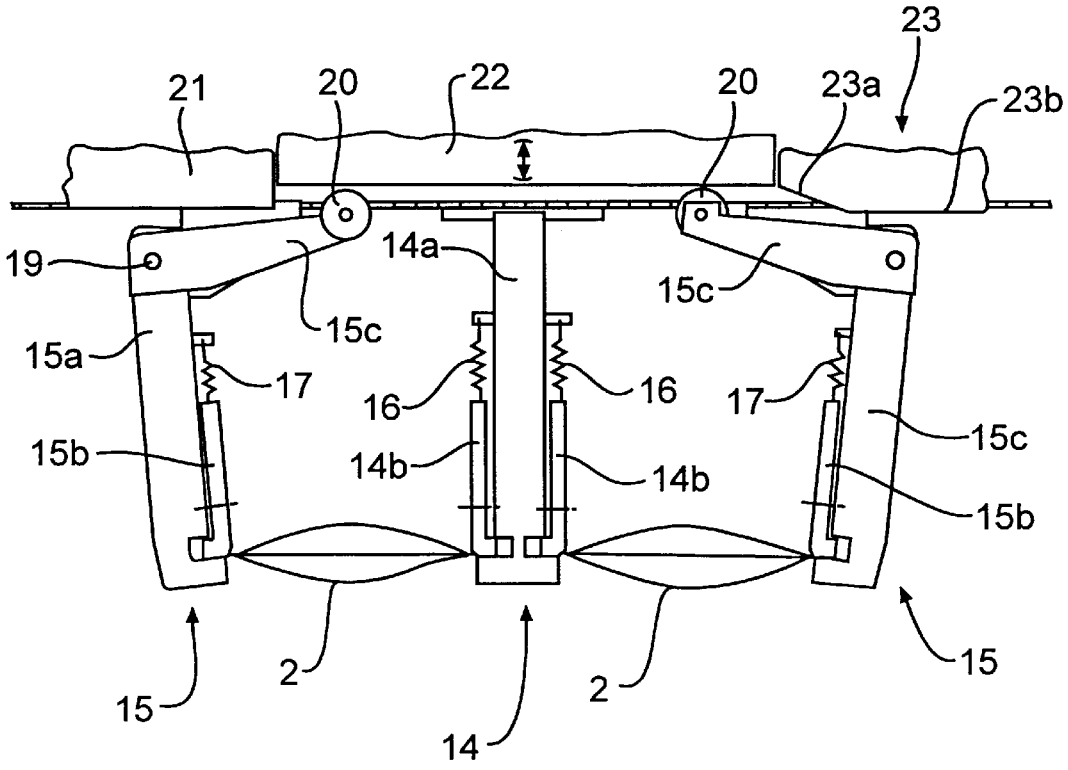
FIG. 8 is a plan view of one of the sets of clips holding two packets at the filling station.

In the packet filling station, the support devices of the end wheels (20) consist of a sliding pusher (22) which, when it enters the plane defined by the front guide sections (21) folds the side clips (15) located in the station, as may be seen in FIG. 8, and so moves the edges towards the central clip (14) in order to open the top of the packets (2) held by the clips.

To help to open the top of the packets, sucker pads, which are not shown in the figures, pull the sides of the packets in opposite directions.

In the packet-top closing station, the support devices of the end wheels (20) consist of two end guide sections (23) that define a front sloping section **(23*a*) and an end section on the same plane as the front guide sections (21). The end sections (23) make the side clips (15) unfold. The clips stretch the tops of the packets (2)** when they are full so that they can be heat-sealed by the packing machine.

Figure 5:
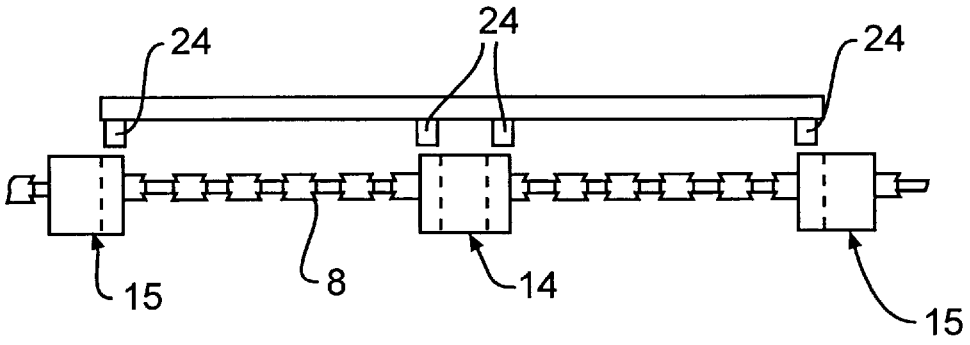
FIG. 5 is a schematic elevation view of one of the sets of clips and of one of the presser bars used to open the clips.
Figure 6:
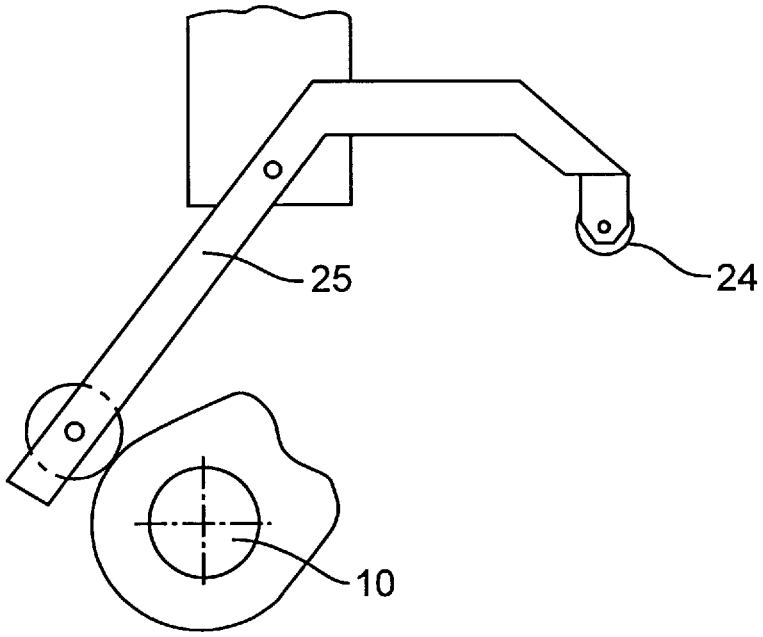
FIG. 6 is a profile view of one of the presser bars showing the device that operates it.

The packet collection and release stations of the device of the invention are equipped with presser bars (24), displayed in FIGS. 4, 5 and 6, that act simultaneously on the presser arms **(14*b* and 15*b*) of each set of clips, making the clips open for a moment when the corresponding springs (16 and 17)** yield.

The presser bars (24) are coupled to a lever (25) that is operated by a camshaft (10), as may be seen in FIG. (6).

The packet-lifting mechanism (6) is also operated by a set of levers (26), shown in FIG. (3) which, like the previous lever (25), is operated by a camshaft (10).

The pusher (22) and the scissors (1) are also operated by the camshaft (10) by means of the corresponding levers.

A fuller description is not given because it is understood that any expert in this field will have enough information to understand the scope of the invention and its derived advantages.

The terms used in the description and the sense thereof should always be considered to be of a non-limiting nature.

The materials, shape, size and layout of the parts are liable to change as long as no change is made to the essential characteristics of the invention, which are described in the following claims.

I claim:

1. A device for handling flexible packages, of the type used in horizontal packing machines for forming packets from a heat-sealable complex sheet, filling the packets with the product to be packed and heat-sealing the openings of the packets when they are full, comprising:

at least one pair of scissors for cutting the packets that are formed continuously from the complex sheet;

a packet-lifting mechanism; and a revolving mechanism movable horizontally, said revolving mechanism comprising a movable chain, and several sets of carrying clips attached horizontally to outer sides of the chain, wherein the carrying clips pick up the packets supplied by the packet-lifting mechanism at a collection station, move the packets horizontally through a packing machine filling station and a sealing station, and release the packets at a packet release station;

wherein the packet-lifting mechanism includes two parallel lifting clips mounted on a bracket located above the revolving mechanism so that the lifting clips are free to move; and wherein the bracket of the packet-lifting mechanism includes one vertical guide and one oblique guide, on which the corresponding lifting-clips move up and down.

2. A device for handling flexible packages, of the type used in horizontal packing machines for forming packets from a heat-sealable complex sheet, filling the packets with the product to be packed and heat-sealing the openings of the packets when they are full, comprising:

at least one pair of scissors for cutting the packets that are formed continuously from the complex sheet:

a packet-lifting mechanism; and a revolving mechanism movable horizontally, said revolving mechanism comprising a movable chain, and several sets of carrying clips attached horizontally to outer sides of the chain, wherein the carrying clips pick up the packets supplied by the packet-lifting mechanism at a collection station, move the packets horizontally through a packing machine filling station and a sealing station, and release the packets at a packet release station;

wherein each set of clips mounted on the revolving mechanism includes a central clip and two side clips.

3. The device of claim 2, wherein the central clip includes a fixed arm and two lateral presser arms operated by two springs for pressing the presser arms against the fixed arm, keeping the presser arms in a closed position.

4. The device of claim 2, wherein the side clips have a folding arm mounted on a bracket attached to the chain by a vertical shaft so that the arms fold and unfold horizontally, thus moving the ends of the side clips respectively closer to and further from the central clip, and a spring-operated presser arm that moves the folding arm.

5. The device of claim 4, wherein an appendage is attached to a side of each of the side clip folding arms, the appendage being equipped with an end wheel; one of said side clips having the end wheel mounted on top of the appendage, and the other below the appendage, so that the end wheels are at different heights.

6. The device of claim 5, wherein the side clips fold and unfold in response to their respective end wheels coming into contact with and being deflected by support devices located parallel to a path followed by the sets of clips.

7. The device of claim 6, wherein the support devices in the collection station include two front guide sections contacted by the end wheels to unfold the respective side clips, and move the side clips a distance from the central clip equal to the width of the packets to be filled.

8. The device of claim 7, wherein the support devices in the packet filling station include a sliding pusher for entering the plane defined by the front guide sections and contacting the end wheels, to fold the side clips located in the filling station and move the side clips closer to the central clip to open the top of the packets held by the respective set of clips.

9. The device of claim 8, wherein the support devices in the sealing station include two end guide sections that define a front sloping section inclined from a plane defined by the sliding pusher to a plane defined by the front guide sections of the collection station, causing the side clips to unfold and closing the packet tops so that they can be heat sealed.

10. The device of claim 3, wherein the packet-collection and release stations are equipped with presser bars acting simultaneously on presser arms to open and close the clips.

11. The device of claim 10, wherein the scissors, the presser bars that open and close the clips, and the lifting clips are operated by a set of independent levers.

12. The device of claim 11, wherein the set of independent levers includes different sets of levers operated by a camshaft coupled to the power unit that moves the revolving mechanism.

* * * * *